US005769947A

United States Patent [19]

Krappweis

[11] Patent Number: 5,769,947

[45] Date of Patent: Jun. 23, 1998

[54] APPLICATOR FOR ADHESIVE AND CORRESPONDING NOZZLE PLATE

[75] Inventor: Andreas Krappweis, Monheim-Baumberg, Germany

[73] Assignee: ITW Dynatech GmbH Klebetechnik, Erkrath, Germany

[21] Appl. No.: 546,754

[22] Filed: Oct. 23, 1995

[30] Foreign Application Priority Data

| | | | |
|---|---|---|---|
| Oct. 22, 1994 | [DE] | Germany | 44 37 764.9 |
| Apr. 12, 1995 | [DE] | Germany | 295 06 334.3 |
| Oct. 14, 1995 | [EP] | European Pat. Off. | 95116217 |

[51] Int. Cl.[6] ..... B05C 1/16; B05C 5/04

[52] U.S. Cl. ..... 118/411; 118/213; 118/223; 118/301; 118/406; 239/556; 239/562; 239/568

[58] Field of Search ..... 118/301, 313, 118/406, 419, 211, 212, 213, 216, 223, 411; 239/556, 557, 562, 566, 567, 568

[56] References Cited

FOREIGN PATENT DOCUMENTS

| | | |
|---|---|---|
| 0224855 | 11/1986 | European Pat. Off. . |
| 0523589 | 7/1992 | European Pat. Off. . |
| 2157710 | 7/1983 | Germany . |
| 3506393 | 2/1985 | Germany . |
| 3804856 | 2/1988 | Germany . |
| 4013322 | 4/1990 | Germany . |

*Primary Examiner*—Donald E. Czala
*Assistant Examiner*—Steven B. Leavitt
*Attorney, Agent, or Firm*—Schwartz & Weinrieb

[57] ABSTRACT

Apparatus is provided for applying glue or a similar adhesive onto a substrate such as a paper web. It comprises a nozzle plate (20) with exit openings (29) with a small diameter, which are arranged in at least two rows (32,33), staggered closely behind one another in the transport direction (4). The rows are also transversely offset with respect to each other such that the outlet openings of one row (33) are aligned with the spaces (37) defined between the outlet openings of another row (32). In this manner, side edge portions (47) of the adhesive issued from the outlet openings of the one row (33) contact and merge with the side edge portions (47) of the adhesive issued from the outlet openings of the other row (32) whereby a continuum of adhesive is produced.

26 Claims, 6 Drawing Sheets

APPLICATOR FOR ADHESIVE AND CORRESPONDING NOZZLE PLATE

FIELD OF THE INVENTION

The present invention relates generally to fluid applicators or dispensers, and more particularly to a device for applying adhesives to substrates, and a corresponding nozzle plate.

BACKGROUND OF THE INVENTION

Adhesive applicator devices are mainly used to apply adhesive to flat material to which glue or a similar adhesive is to be applied, such as cut pieces or webs of cardboard, paper, textile, non-woven material, or similar materials, according to a predetermined pattern. However, the term "fluid application medium such as glue or a similar adhesive" includes not only other adhesion agents such as adhesives and hot-melt glues, but also means that the invention extends to cover those application media which demonstrate suitable properties for application with the device, in terms of their consistency and their physical behavior. Therefore, other fluid media, particularly viscous media such as lubricants and paints, as well as possibly also gases, can be used as application media, in addition to glue, if they are to provoke chemical reactions, for example, on the area where they impact on the substrate.

The substrate will generally be moved past the fixed applicator device in a level web. In principle, however, the substrate can alternatively be fixed in place and the applicator can be moved. Application systems with a combined movement of the applicator and the substrate are also not precluded.

To achieve a strip-like track of an application medium such as glue, slit nozzles are used in many cases, such as those known from EP 224 855 A2. Such slit nozzles fulfill their purpose as long as the relative velocity of the substrate relative to the applicator is not too high.

The starting point of the invention, however, was the problem of producing strip-like glue tracks at an application amount of 8 to 10 g/m$^2$ within the track, at speeds of over 200 to as much as 600 m/min. Such speeds occur in the cigarette industry in connection with the application of the glue tracks for the longitudinal seam of the cigarette, for gluing in the filter, and for gluing on the filter cover paper at the mouthpiece.

It has been shown that conventional slit nozzles reach their operational limits at the state speeds because it is no longer possible to maintain a defined width of the glue track, as is absolutely required by the users.

The lack of precision in maintaining the width of the glue track as deposited by the slit nozzles is connected with the fact that with the required small application amounts and the very high transport speeds of the substrate, the substrate speed is markedly higher than the exit speed of the glue out of the nozzle. The strand of glue is therefore elongated in the longitudinal direction after exiting from the nozzle, and because of the volume constancy, it is therefore constricted in the width direction. This constriction is dependent on the momentary transport speed of the application medium and the transport speed of the substrate, and therefore varies depending on the operation conditions.

From a company brochure of the company Dittberner GmbH entitled "Kaltleim-Auftragsgerat" (Cold Glue Applicator), an applicator head is known in which a number of small bores of 0.7 or 1.0 mm are arranged next to each one another in a line cross-wise to the transport direction. In this embodiment, the constriction effect also occurs, but here it has the result that the glue filaments exiting from the individual bores separate from one another and are deposited on the substrate as individual filaments which have no connection with one another in the cross-wise direction with respect to the transport direction. Therefore, here again, there is no glue track with desired uniform glue application properties over the width of the glue track.

This is even more apparent for embodiments according to DE 21 57 710 C2 or DE 40 13 322 A1, in which separate glue valves are arranged closely adjacent to one another. Here again, a pattern of separate glue tracks results, but due to the design, they define a gap which has a dimension substantially equal to any space defined between the adjacent glue valves and are not suitable for the purposes of the invention, for example, in the cigarette industry.

OBJECT OF THE INVENTION

The present invention is based on the task of creating an applicator for the application media in question, which can be used to produce a strip-shaped track with the greatest possible accuracy being maintained in terms of width, and uniform application over the width of the track, even at very high speeds of the substrate relative to the applicator.

SUMMARY OF THE INVENTION

The foregoing task is accomplished by means of the invention described in the following specification.

More particularly, in accordance with the present invention at least two rows of exit openings, staggered in the transport direction, are present and are dimensioned and arranged in such a way that the strands of the application medium from the back row of the exit openings in each instance are interposed between the strands exiting from the adjacent exit openings of the front row in each instance, and in addition they touch each other at their edges so that due to cohesion, they pass over into or commingle with one another whereby a uniform layer forms in the width direction.

It is true that the constriction effect continues to occur at the outermost exit openings of the track, and this leads to lateral constriction of several percent in the width of the exit openings at such locations. However, with reference to the overall width of the track, which is produced by means of a plurality of such exit openings, the width error is small enough to be ignored. The reason for this is the division of the total adhesive application amount among a plurality of very small exit openings, with the constriction in the interior of the overall width being rectified by the cohesion of adjacent edges of the individual strands which occurs there. With respect to the cross-sectional dimensions of the exit openings, values in the range of 0.2 to 2.0 mm are possible.

The connection line between the center points of the exit openings adjacent to each other in the cross-wise direction is to be understood as a "row".

When there are two rows of openings, the arrangement of the exit openings is self-evident. When there are three or more rows of openings, various possibilities exist as to the arrangement of the openings, with the arrangements according to FIGS. 14–17 being particularly possible for implementing the invention.

Pursuant to one arrangement of the openings in accordance with the present invention, the openings can be provided such that the distance between the exit openings of the row located forwardly in the transport direction essentially corresponds to the diameter of the exit openings of the following row in the transport direction. The strands of application medium exiting from the individual exit openings therefore just touch each other.

In order to ensure this contact, however, an overlap pursuant to another arrangement of the openings can also be recommended.

In the preferred embodiment of the invention, the diameters of the exit openings of both rows are equal to each other and are, for example, 0.5 mm.

However, in certain cases, depending on the operating conditions and the properties of the application medium, it can also be practical to select the diameters in consecutive rows as being different.

Likewise, the exit openings of a particular row can have the same diameter, which has advantages for production reasons, or they can be different within different rows, where a reduction in the diameter of the exit openings at the end positions, in particular, can be practical in order to minimize the influence of constriction at the edges of the application.

The rows of the exit openings should follow closely upon each other, in order to promote the formation of a cohesive track of application medium. Pursuant to a feature of the invention, the distance in the transport direction should correspond at most to approximately the diameter of the exit openings of one of the rows.

Also with regard to the arrangement in the longitudinal direction, an overlapping array of the openings can be recommended, that is, the rear exit openings in the transport direction should be somewhat disposed within the gaps defined between the adjacent front exit openings. This again promotes the formation of a cohesive track of the application medium, because the strand of the application medium exiting from the rear exit opening in each instance can already touch the edges of the strands exiting from the adjacent front exit openings and melt together with them before lateral constriction, which is a factor of speed, plays a significant role.

In accordance with the preferred embodiment example of the invention,the exit openings are arranged in straight lines, cross-wise to the transport direction of the substrate and the exit openings have a circular cross-section.

In the latter case, the exit openings can be formed by bores of a corresponding diameter, which have been produced by means of spiral drills, using electro-erosion or a similar process.

Diameters which are primarily possible, particularly in the case of adhesive application for the production of cigarettes within the cigarette industry as mentioned initially, for the circular exit openings may be within the range of 0.2 to 1.0 mm.

However, the exit openings do not necessarily have to have a circular cross-section. They also do not have to be located entirely separate from one another in the delimitation surface into which they open.

An important alternative embodiment is rather one in which the exit openings are alternately adjacent to a plane, as grooves approaching the plane from different sides, and are adjacent to each other in the direction of the plane.

The dimensions of such grooves can vary in both depth and width.

A method of producing such an exit opening arrangement which is important for practical use is also disclosed. The applicator head is divided into parts, and the parts have the grooves, which can be milled with a suitable tool, specifically with a multi-use tool, several at once, in the adjacent part surfaces. As compared with drilling the exit openings, this represents a simplification in production.

Although the applicator head upon which the delimitation surface, with the application openings, is formed is generally made of steel with a higher level of hardness, it has been shown that particularly for exit openings with slight cross-sectional dimensions, through which the glue or similar adhesive must be pressed at high speed due to the high substrate speeds which are achieved, significant wear phenomena occur over the course of time.

In order to counteract this, the exit openings are incorporated within an exit region which comprises a strip which is made from a material with greater wear resistance. The wear occurs predominantly only in the exit region, so that only this region is important. Production of the entire applicator head from the material with greater wear resistance would represent an overly high expense, which is also unnecessary outside of the exit region.

It is preferred that the strip consist of an electrically conductive material, that is, of a hard metal or an electrically conductive ceramic material (cermet). The reason for the electrical conductivity is that the fine exit openings in such materials can no longer be drilled with spiral drills, because the materials might be harder than the drill bits. Here, the exit openings are, instead, defined or formed by means of an electro-erosive device, which necessitates conductivity of the workpiece.

While the strip can be composed of individual pieces, it is preferred that it extends continuously over the entire width of the applicator head.

As already mentioned, the only decisive factor for the operating principle of the invention is the relative movement between the applicator head and the substrate. This means that the substrate could also be moved. The embodiment which is by far preferred, however, is the one in which the arrangement of the exit openings is fixed in place and the substrate is moved past them.

It is practical that the exit openings are provided within a nozzle plate which can be affixed to an applicator head, and wherein the nozzle plate can be unscrewed from the applicator head when the application pattern is to be changed, without the applicator head itself having to be disassembled.

The invention is also realized in accordance with a nozzle plate such as one which comprises a distributor chamber. The distributor chamber is important in order to guarantee uniform existence of the application medium from all the discharge openings which proceed from the distributor chamber.

It is understood that such a nozzle plate contains the exit openings in the arrangement already described for the applicator.

The present invention also comprises the presence of a tear-off edge which guarantees a smooth transition of the strands, that is, the track of the application medium, from the applicator head to the substrate. In and of itself, however, the tear-off strip is generally known in the state of the art and is evident, for example, from the company brochure of the company Dittberner GmbH and from DE 35 06 393 A1.

It has proven to be important for uniform and clean formation of the track of the application medium that the exit openings lie as close as possible to the tear-off edge. But in order to be able to house a sufficiently large distributor chamber above the exit openings, a substantial amount of material is required in this region. A bevel provided upon the nozzle plate makes it possible to locate the tear-off edge within the vicinity of the front edge of the exit openings and within the plane of the exit openings.

The present invention also contemplates the provision of a continuous lateral connection of application tracks produced by distributor chambers which are adjacent to each other in a cross-wise arrangement or direction with respect to the transport direction.

The invention is also realized, in the important application example of a cigarette production machine in which a device applies strip-shaped glue tracks onto the cigarette paper or the filter paper, and/or a nozzle plate for achieving the deposition of the adhesive or glue.

BRIEF DESCRIPTION OF THE DRAWINGS

Various other objects, features, and attendant advantages of the present invention will be more fully appreciated from the following detailed description when considered in connection with the accompanying drawings which illustrate several embodiment examples of the invention, in which the same or similar reference characters designate like or corresponding parts of the invention throughout the several views thereof, and wherein.

DETAILED DESCRIPTION OF THE ILLUSTRATED EMBODIMENTS

Figure 1:
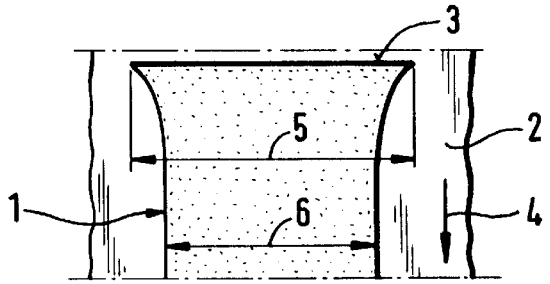
FIG. 1 is a diagrammatic view which shows the effect of constriction at a slit nozzle.

Referring now to the drawings, FIG. 1 shows the application of a strip-shaped application track 1 of glue onto a substrate 2, from a slit nozzle which is only represented by a line which represents the exit slot 3. The substrate 2, for example a paper web or a paper strip, runs past the fixed exit nozzle 3, at a slight distance from it, in the direction of the arrow 4. The width of such a glue track 1 can amount to a few millimeters or as much as several tens of millimeters.

If the substrate 2 is moved past the exit nozzle 3, in the direction of the arrow 4, at a relatively low speed, the width of the glue track 1 essentially corresponds to the width 5 of the exit nozzle 3.

However, if the speed of the substrate is increased to several hundred meters per minute, it is above the exit speed of the glue from the exit nozzle 3. This causes the glue strand to be stretched in the longitudinal direction before it is completely deposited on the substrate 2, and it is constricted laterally in the manner evident from FIG. 1, from its original width 5 to a lesser width 6, which forms the width of the glue track 1 which can be achieved with the exit slit 3 at the speed in question. In the embodiment example shown, the constriction is shown in an exaggerated manner. In fact, it lies in the range of several %, in most cases below approximately 10%.

If the operating speed of the system changes, the constriction can also change, so that at high speeds, the desired glue track with a defined width cannot be achieved with the known exit slot.

Width variations on the order in question are particularly unacceptable for the cigarette industry, where it is important to maintain the application width of the glue track as precisely as possible, even at very high speeds up to 600 m/min.

Figure 2:
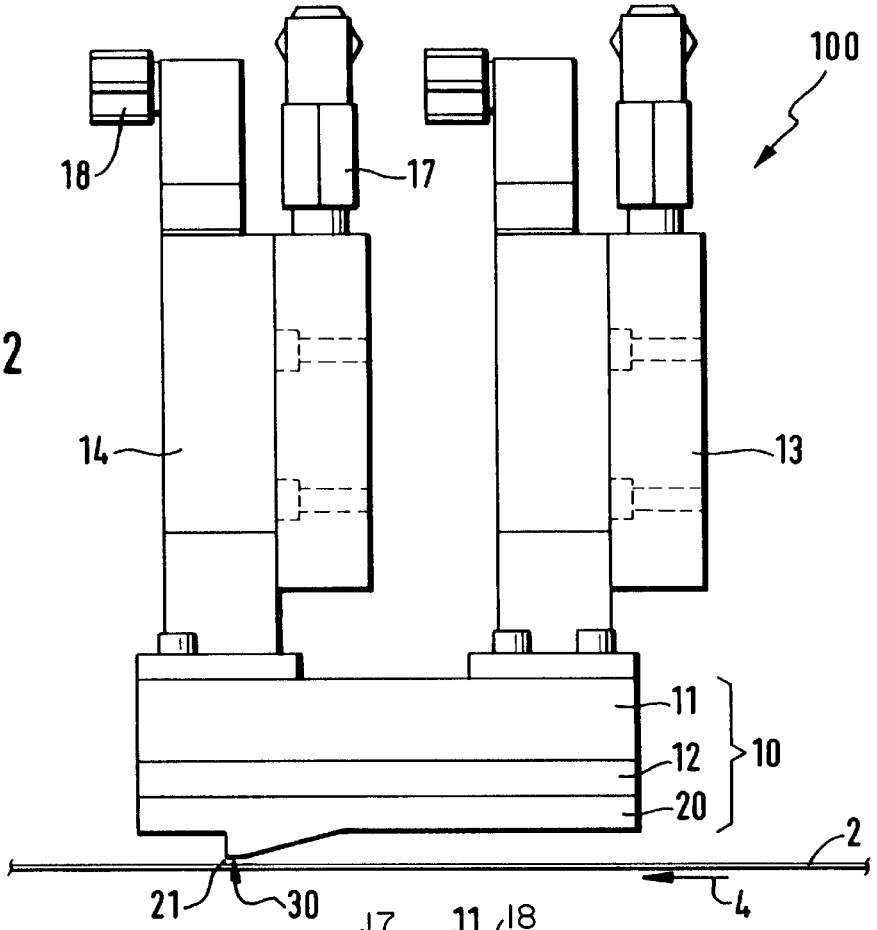
FIG. 2 is a side view of an applicator head according to the invention.
Figure 3:
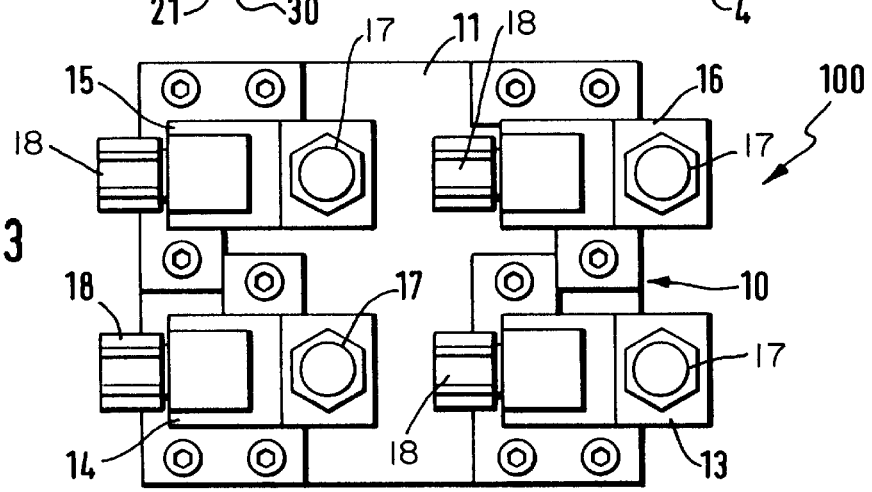
FIG. 3 is a view in accordance with FIG. 2, from the top.

FIGS. 2 and 3 show an applicator head which can be used to better maintain the width of the track of an application medium, such as glue, which is produced, even at very high speeds.

This is possible with the applicator device shown in FIGS. 2 and 3, designated as a whole by the reference character 100, which has a block-shaped applicator head designated as a whole by the reference character 10, where four similar glue valves 13, 14, 15, 16 with connections 17, 18 to supply glue and electrical energy for valve control are arranged on the side which is on the top when the apparatus is disposed in the operating position.

Figure 4:
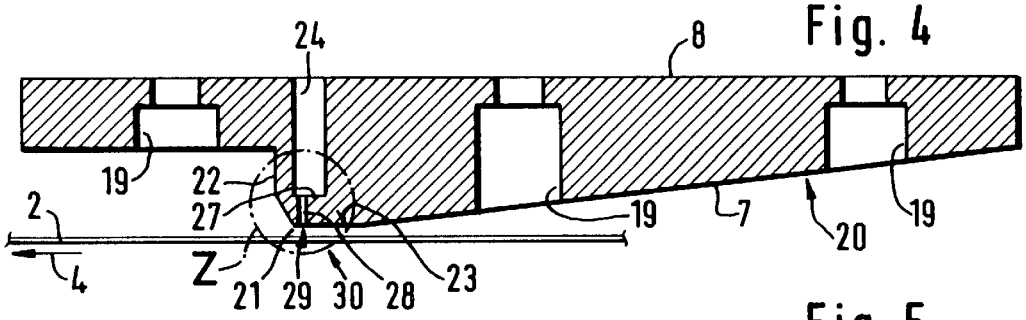
FIG. 4 is a longitudinal cross-section through the nozzle plate along the line 4—4 in FIG. 5.

The applicator head 10 comprises a plate-shaped carrier 11 with internal passages for the glue, a channel plate 12, with internal channels to distribute the glue, arranged below the carrier 11, and a nozzle plate 20 with a tear-off edge 21 and an arrangement of exit openings 29, designated as a whole by means of the reference character 30, as best seen in FIG. 4, from which openings 29 the glue is issued onto the top surface of the substrate 2, which is transported past the applicator head 10 with the substrate disposed closely below or resting against the applicator head 10, in the direction of the arrow 4, as controlled by the glue valves 13, 14, 15, 16, which can be electrically controlled in accordance with a high switching frequency.

FIG. 4 shows the nozzle plate 20 in longitudinal cross-section. It contains dead-end bores 19 for screws, by means of which the nozzle plate 20 can be secured to the channel plate 12 and the carrier 11. A region which is important to the understanding of the present invention, and which will be discussed more fully in detail hereinafter, is marked with the circle Z.

The nozzle plate 20 comprises a slanted underside 7 at its rear part, which rises slightly towards the level top 8, in a direction opposite the transport direction 4. Close to the region of the arrangement 30 of the exit openings 29, the underside 7 makes a transition into a delimitation surface 23, which extends at least over the region of this arrangement 30 and is level and parallel to the substrate 2. From the top 8, that is, the supply side of the nozzle plate 20, distributor chambers 24, 25, 26 extend into the depth of the nozzle plate 20, through the bottom 27 of which bores 28 are defined so as to be disposed approximately perpendicular to the top 8 of the nozzle plate 20, which bores 28 open into the exit openings 29 defined within the delimitation surface 23.

Figure 5:
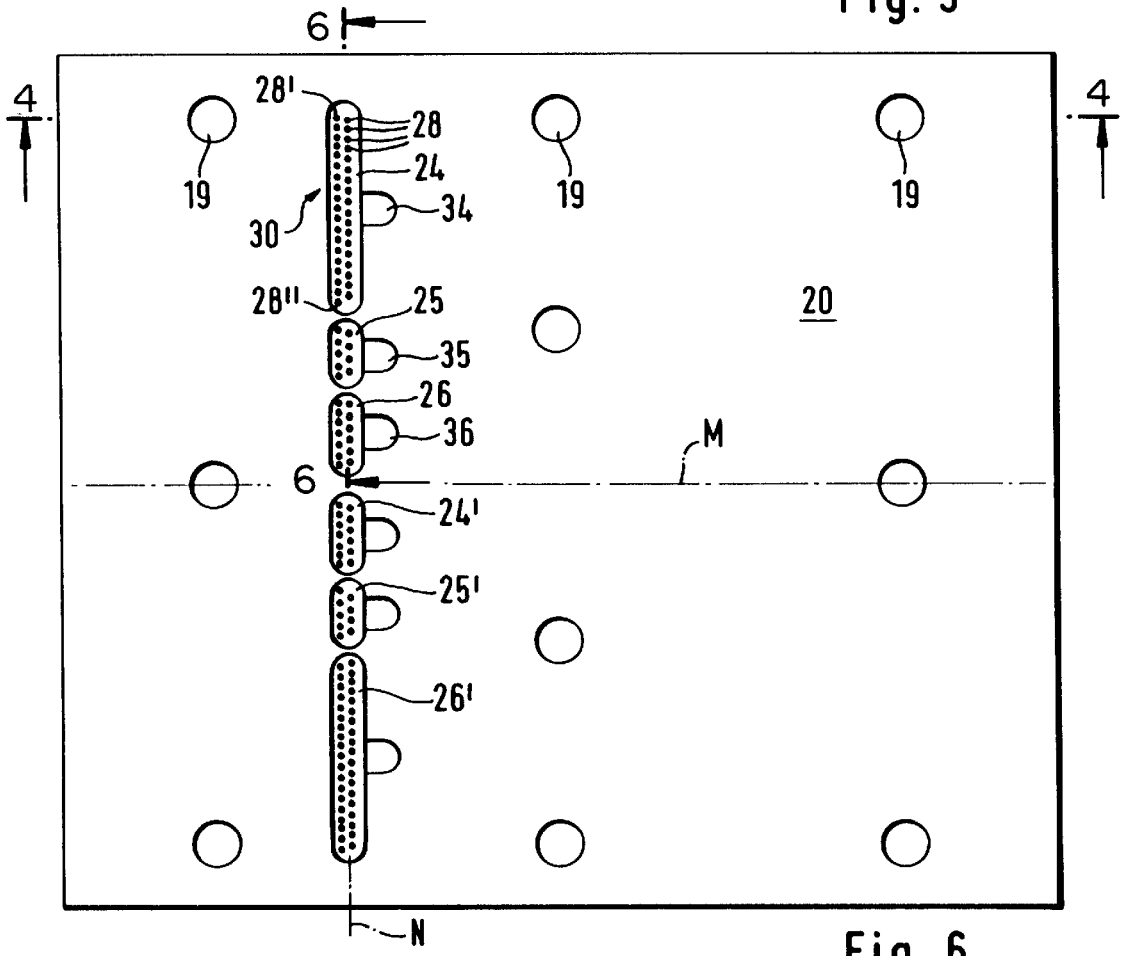
FIG. 5 is a view in accordance with FIG. 4, from above.
Figure 6:
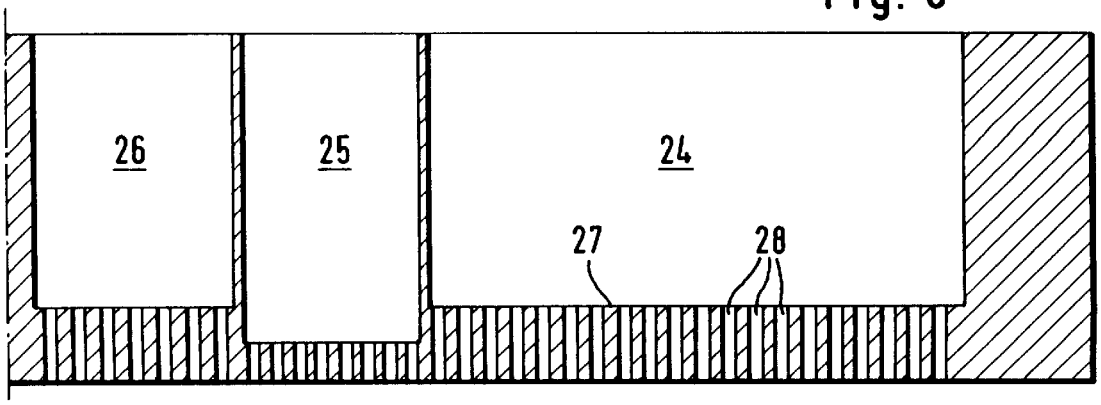
FIG. 6 ss a cross-section along the line 6—6 in FIG. 5.

In the embodiment example shown in FIG. 5, the distributor chambers 24 comprise oblong grooves milled into the nozzle plate 20 from above, the bottoms 27 of which are almost entirely covered by the arrangement 30 of the exit openings 29. A distributor chamber 24, 25, 26, in each instance, yields a glue track with the corresponding width on the substrate 2. The arrangement 30 of the exit openings 29, that is, of the individual distributor chambers 24, 25, 26 is determined by the desired glue application pattern. In the case shown in FIG. 5, the glue application pattern is symmetrical with respect to the longitudinal center plane M, that is, similar distributor chambers 24', 25' 26' are provided on the opposite side of the longitudinal center plane M, in a mirror-image arrangement. This arrangement allows a glue application pattern in accordance with FIG. 24, which will be explained in greater detail hereinafter.

The distributor chambers 24, 25, 26 are in fluidic communication with flat connection channels 34, 35, 36 defined within the top surface of the nozzle plate 20 as seen in FIG. 5, into which the supply channels of the channel plate 12 open. The glue which enters from the channel plate 12 above is horizontally deflected into the connection channels 34, 35, 36, and subsequently deflected once again, vertically into the distributor chambers 24, 25, 26. This multiple deflection is of importance for uniform distribution of the glue in the distributor chambers 24, 25, 26. The relatively large flow cross-section of the distributor chambers 24, 25, 26 also serves the purpose of uniform distribution of the glue in that such cross-section of the chambers 24,25,26 significantly exceeds the total cross-section of all the bores 28 which open into the distributor chamber in question, and which form the exit openings 29.

The distributor chambers 24, 25, 26, 24', 25', 26' possess a common center line N, which extends cross-wise with respect to the transport direction 4 of the substrate 2. The chambers 24–26' also lie close to the tear-off edge 21.

Figure 7:
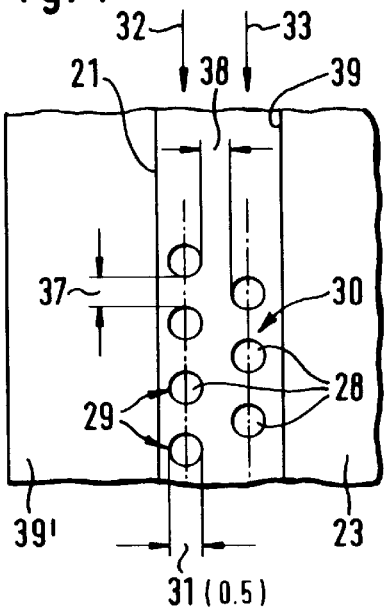
FIG. 7 is a view showing the arrangement of the exit nozzles at the location Z circled in FIG. 4, from below.
Figure 8:
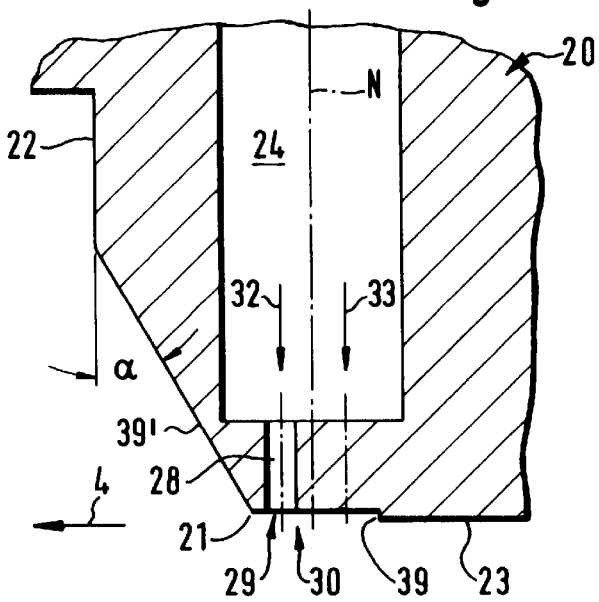
FIG. 8 is a partial cross-section from FIG. 4, at the location circled, on an enlarged scale.
Figure 9:
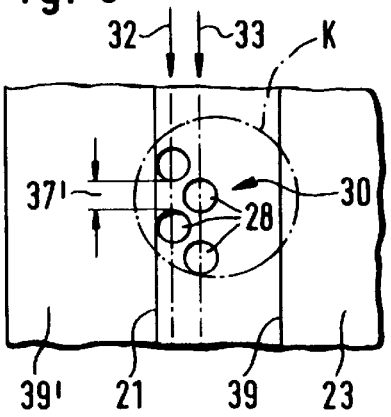
FIG. 9 is a view similar to that of FIG. 7 which shows an alternative arrangement of the exit openings.

FIGS. 7 to 9 show the structure and arrangement of the exit openings 29 in more detail. FIG. 7 is a view directed towards the underside of the arrangement 30 of the exit openings 29 in the region of the nozzle plate 20 marked with the circle Z in FIG. 4. The individual bores 28 which form the exit openings 29 in the embodiment example shown possess a diameter 31 of 0.5 mm. The exit openings 29 are arranged in two rows which are staggered in the transport direction 4 so as to define a front row 32, as considered in the transport direction 4, and a subsequent or rear row 33, as considered in the transport direction 4. The lateral distances 37 between each of two adjacent exit openings 29 of the front row 32 correspond to the diameter 31 of the bores 28. The distance 38 between the rear delimitation of the row 32 and the front delimitation of the row 33 also corresponds to the diameter 31. The exit openings 29 of the back row 33 are precisely aligned behind the spaces defined between the adjacent exit openings 29 of the front row 32. While the bore diameters in FIGS. 7 and 9 are all the same, this is not compulsory. For example, the bores 28 of the back row 33 can have a greater diameter than those of the front row 32, which would then be moved apart accordingly.

The exit openings 29 are generally moved as close as possible to the tear-off edge 21, which is formed at a shoulder 22 (FIGS. 4 and 8) provided upon the underside of the nozzle plate 20 at a forward location as considered in the transport direction 4. The bottom edge of the shoulder 22 which represents the tear-off edge 21 is offset backwards within the vicinity of the exit openings 29 by means of a bevel 39', relative to the front delimitation of the distributor chamber 24. In the embodiment shown, the bevel 39' forms an angle $\alpha$ of 30° with respect to a plane perpendicular to the transport direction 4 as best seen in FIG. 8. As can be seen in FIG. 8, a flat depression 39 is machined within the surface 23 of the nozzle plate 20 and within the region of the arrangement 30 of the exit openings 29, with the purpose of creating room for the application medium on the substrate 2 when the substrate is transported past the arrangement 30 of the exit openings 29 while being supported by or disposed against the delimitation surface 23.

FIG. 9 shows a modified embodiment of the nozzle plate 20 in which the exit openings 29 of the front row 32 are moved still closer to the tear-off edge 21. The distance between two adjacent exit openings 29 in the front row 32 is 10% smaller than the diameter of the exit openings 29 of the back row 33. A distance corresponding to the distance 38 between the rear and front delimitations of the rows 32 and 33 no longer exists; instead the exit openings 29 of the back row 33 are disposed forwardly by approximately 10% of their diameter, so as to be partially between the exit openings 29 of the front row 32, so that the glue strands which exit from the exit openings 29 of the back row 33 immediately make contact with the glue strands which exit from the adjacent front row exit openings 29, at their lateral delimitations.

In FIG. 9, the center lines of rows 32, 33 indicate that the sequence of the bores towards the lateral sides is supposed to continue, as needed for the width of the glue strip to be produced. However, if this glue strip is only supposed to have a slight width of approximately 2 mm, the entire configuration of four bores 28 in rows 32 and 33 can suffice. For this purpose, the distributor chamber then does not need to consist of an oblong groove, but rather can be formed of a dead-end bore which is formed within the nozzle plate 20 so as to extend downwardly from the top surface 8, and the outline of which is indicated by the dot-dash circle K.

The advantage of the arrangements 30 of exit openings 29 as shown in FIGS. 7 and 9 is particularly noticeable at high speeds of the substrate 2 relative to the applicator 100. Strip-shaped glue tracks 1 can be achieved, the widths of which are dependent on speed only to an insignificant degree. For example, let us look at FIG. 5. While the constriction effect in accordance with FIG. 1 continues to occur at the two outermost bores 28' and 28", only half the constriction affects the outside edge of the glue strip, because the glue strands of all inner exit openings 29 run together at their edges to form a closed glue track. This means that at high speeds, there is a reduction in width which corresponds to the reduction at a single exit opening, or in other words, for example, 5% of 0.5 mm=0.025 mm. Calculated for the entire width of the glue track produced by means of the distributor chamber 24, this amount is insignificant. Furthermore, uniform application of the glue having a predetermined coating depth results over the width of the track.

Figure 11:
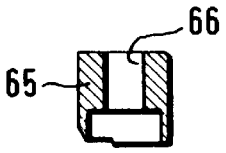
FIG. 11 is a cross-section through the strip of FIG. 10 at an attachment point.
Figure 10:
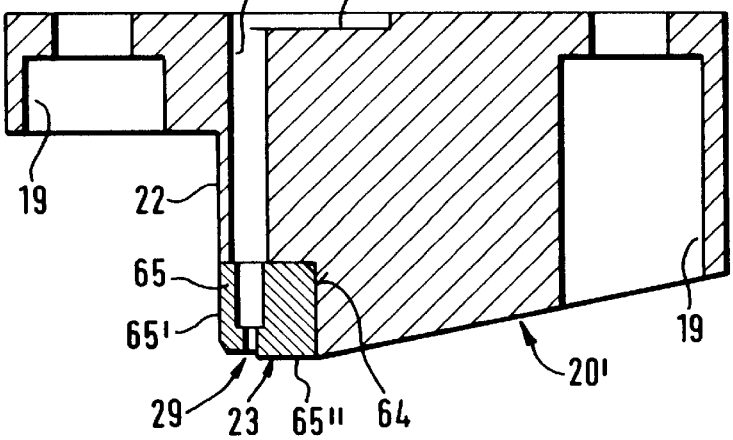
FIG. 10 is a longitudinal cross-section through a nozzle plate corresponding to FIG. 4, showing, however, an arrangement of the exit openings formed within a separate strip.

In the embodiment examples discussed until now, the nozzle plate 20 was made in one piece, including the region within which the exit openings 29 are defined. However,it has been shown that particularly for small exit cross-sections and high speeds at such fine exit openings, notable wear can occur if the surrounding material is common steel. The wear problem can be eliminated by means of the nozzle plate 20' of FIG. 10, in which a strip 65 which extends over its width, or in other words perpendicular to the plane of the drawing in FIG. 10, and consists of a wear-resistant material, for example, a hard material such as hard metal or cermet, is inserted into the exit region, in a corresponding recess 64 of the base element of the nozzle plate 20'. The strip 65 is aligned with the shoulder 22 at its front side 65', and forms the delimitation surface 23, into which the exit openings 29 open outwardly, along its bottom 65". The strip 65 is attached to the base element of the nozzle plate 20' by means of screws which pass through bores 66 in the strip 65 at points which are offset relative to the cross-sectional plane of FIG. 10 in a direction perpendicular to the plane of the drawing, as shown in FIG. 11. The cross-section of the strip 65 is approximately square in the embodiment example shown, but it can also be rectangular, for example.

Figure 12:
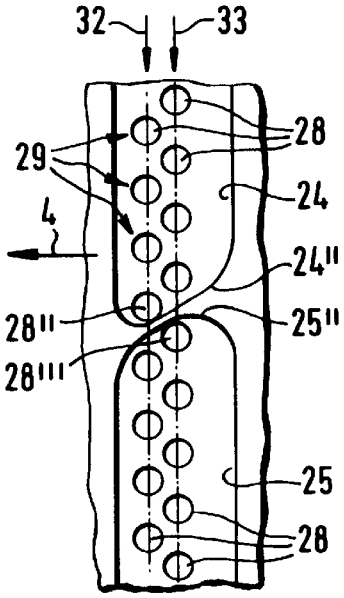
FIG. 12 is a view similar to that of FIGS. 7 and 9 which shows a version of the adjacent delimitations of adjacent distributor chambers as viewed from the top down into the distributor chambers.

FIG. 12 illustrates an embodiment of distributor chambers 24, 25 which are adjacent to one another at their ends, cross-wise to the transport direction 4, in which the lateral connection of the tracks of the application medium produced by the two distributor chambers 24, 25, that is, the tracks of the glue, on the substrate is especially perfect.

This is because the pattern of the arrangement and the form of the bores 28 continues across the adjacent delimitations 24" and 25" of the distributor chambers 24, 25. The rows 32, 33 of the bores 28 continue without interruption or change despite the change from one distributor chamber 24 to the other distributor chamber 25. The bore pattern does not indicate or exhibit the presence of two distributor chambers 24, 25 in any way. This also holds true for the glue track produced with the arrangement according to FIG. 12, in which the portion of the glue track produced by the distributor chamber 24 makes a lateral transition into the portion of the glue track produced by the distributor chamber 25, without the joint therebetween being apparent.

In order to accomplish this, the delimitations 24" and 25" of the distributor chambers 24 and 25, respectively, which are perpendicular to the top 8 of the nozzle plate 20, ex tend between the bores 28" and 28"' at a slant, as is evident in FIG. 12. By means of the slanted arrangement of the delimitations 24" and 25" in a plane parallel to the top 8, there is sufficient space left between the locations of the bores 28" and 28"', which face each other to define a thin delimitation wall which separates the distributor chambers 24 and 25 from each other, so that they can be operated jointly or separately.

Figure 13:
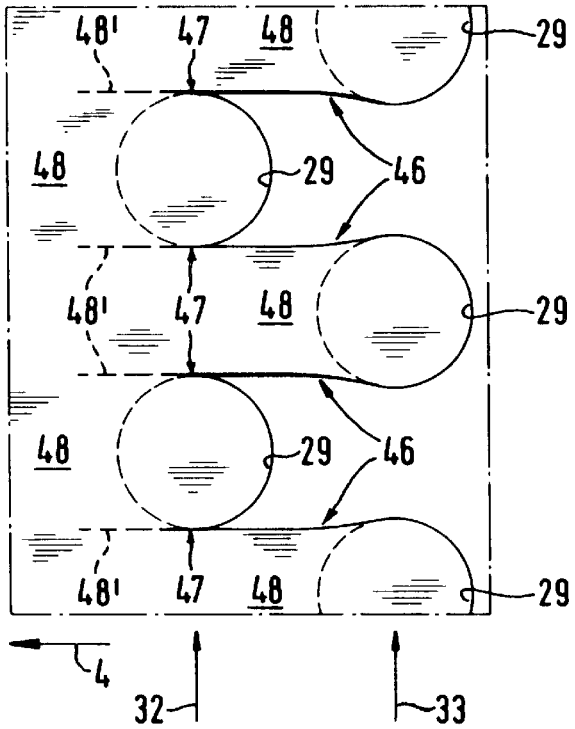
FIG. 13 is a plan view which shows a greatly enlarged representation of some exit openings which interact with each other, illustrating the principle of the invention.

FIG. 13 illustrates details from the arrangement 30 of the exit openings 29 shown in FIG. 7, on a greatly enlarged scale, in order to further explain the principles of the invention. The exit openings 29 are arranged in the two rows 32, 33, and the exit openings of the row 32, which are located forwardly in the movement direction 4 of the paper or other substrate, are located within the spaces defined between the exit openings 29 of the row 33. The application tracks 48 of the row 33 constrict slightly at 46, in the cross-wise direction. However, the diameters and distances of the exit openings 29 are coordinated with respect to one another in such a way that the exit tracks 48 of the row 33 come into contact with the exit tracks 48 of the row 32, for example at the locations 47, and both groups of exit tracks 48 merge into each other at their lateral edges, so that a uniform application with a larger width comes about. The lateral delimitations 48' of the application tracks 48 disappear shortly after contact of the application tracks 48 with each other and are therefore only shown with a broken line for a short distance in FIG. 13.

How the dimensions of the distances and the diameters of the exit openings 29 are to be determined in an individual instance depends on the operating conditions as well as on the speed of the substrate and on the properties of the application medium, such as viscosity, stickiness, and similar qualities, and must be attuned to each specific case.

In FIGS. 7–9, 12, and 13, the exit openings 29 are arranged in two rows 32, 33, which lie one behind the other in the movement direction 4. However, this is not compulsory. FIGS. 14–17 show embodiment examples with more than two rows of exit openings 29 located one behind the other in the movement direction 4.

Figure 14:
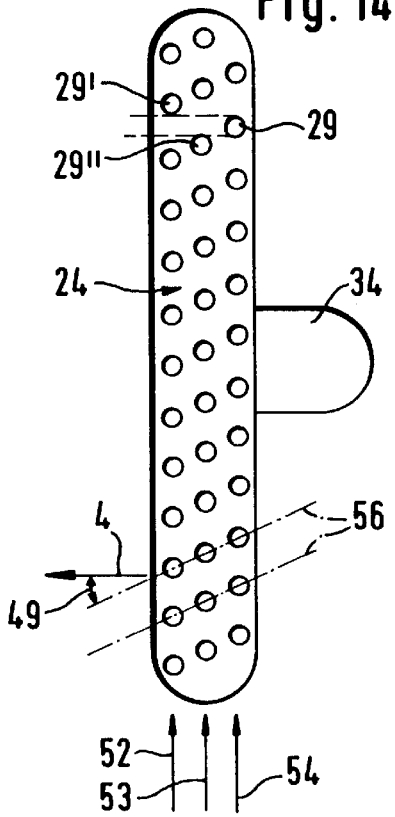
FIGS. 14 to 17 are views, similar to that of FIG. 7, which illustrate examples of alternative arrangements of exit openings.

In FIG. 14, three consecutive rows 52, 53, 54 of openings in the movement direction 4 are arranged in a distributor chamber 24, along slanted or inclined lines 56 which are oriented in the same direction, that is, they are parallel to each other. Here again, the principle is that exit openings 29 which are adjacent to each other in the cross-wise direction are dimensioned and arranged in such a way that the application tracks of the exit openings of the various rows 52, 53, 54 which are adjacent to each other in the cross-wise direction will touch each other at the lateral edges and merge together. An example of this operating principle is illustrated at the top of FIG. 14. The application track of the exit opening 29 of the row 54 touches the application track of the exit opening 29" of the center row 53 along its lower longitudinal edge, as well as the application track of the exit opening 29' of the front row 52 along its upper longitudinal edge.

Figure 15:
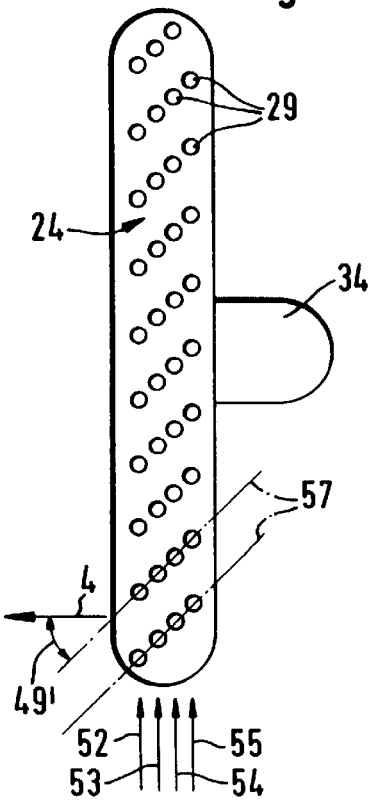

Due to the relatively large distances defined between the rows 52, 53, and 54 in the movement direction 4, the angle 49 which the slanted lines 56 define with reference to the movement direction 4, in the embodiment example of FIG. 14, is only about 25°, while the corresponding angle 49' in the embodiment example of FIG. 15 is approximately 45°. In this embodiment example, the exit openings 29 are provided in four rows 52, 53, 54, 55, which follow relatively closely behind one another in the movement direction 4. In order to achieve contact at the border lines 48' as previously noted in connection with the discussion of FIG. 13, the slanted line or locus 57 must be placed at a greater angle than similar loci of the other embodiments.

The slanted lines 56, 57 of FIGS. 14 and 15, on which the exit openings 29 are located, all run parallel to each other as seen in FIGS. 14 and 15.

Figure 16:
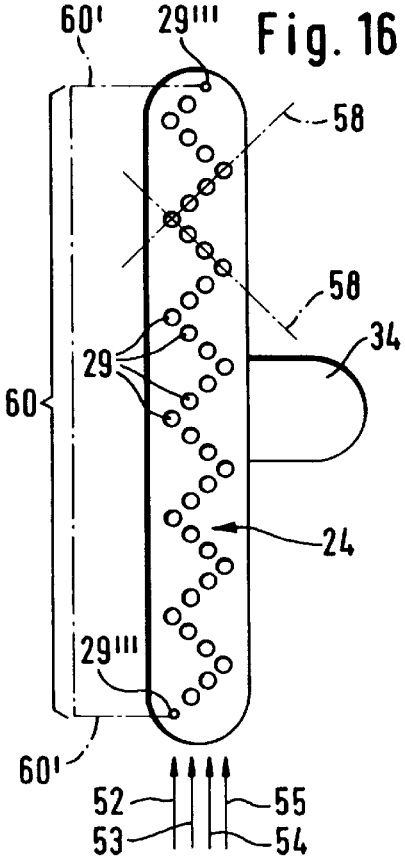

In the embodiment example of FIG. 16, the slanted lines or loci of the exit openings 58 are arranged in a zig-zag pattern, that is, four exit openings 29 are arranged along slanted lines 58 which are at a 90 angle to one another. Here again, four consecutive rows 52, 53, 54, 55 are formed in the movement direction 4.

In FIGS. 14 and 15, all the exit openings 29 have the same diameter. This also holds true for the exit openings 29 located inside the distributor chamber 24 in FIG. 16. Only the two end-position exit openings 29''', in other words the outermost ones, which delimit the edges 60' of the application strip 60 which is produced overall,are slightly reduced in diameter, in order to further reduce the slight influence of constriction of the application track as previously noted at 46 in FIG. 13.

Figure 17:
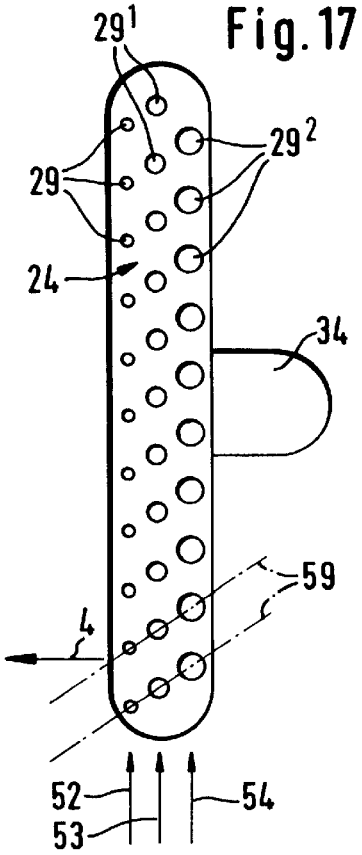
Figure 19:
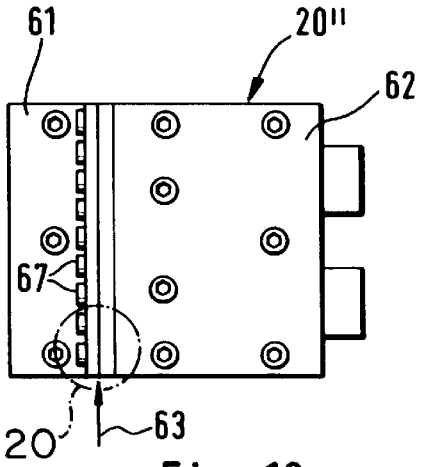
FIG. 19 is a view in accordance with FIG. 18 from below.

The embodiment of FIG. 17 corresponds to that of FIG. 14 in terms of the arrangement of the exit openings 29 in three rows 52, 53, 54 along parallel slanted lines 59. The difference, however, is that the exit openings $29^1$ of the row 53 have a larger diameter than the exit openings 29 of the row 52, and the exit openings $29^2$ of the row 54 in turn have a larger diameter than the exit openings $29^1$ of the row 53. In this embodiment, the diameters of the exit openings $29^2$ are approximately twice as large as those of the exit openings 29. However, the condition that exit openings 29, $29^1$, and $29^2$, which are adjacent to each other in the cross-wise direction, must be dimensioned and arranged in such a way that the exit tracks touch each other at their lateral edges and merge together, is nevertheless fulfilled here also.

Figure 20:
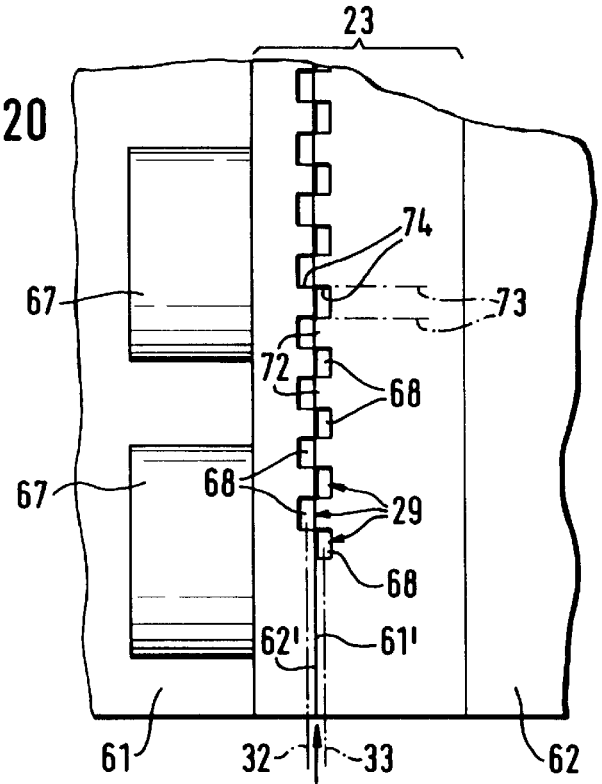
FIG. 20 is an enlarged representation of the region indicated in FIG. 19 with the circle 20.
Figure 18:
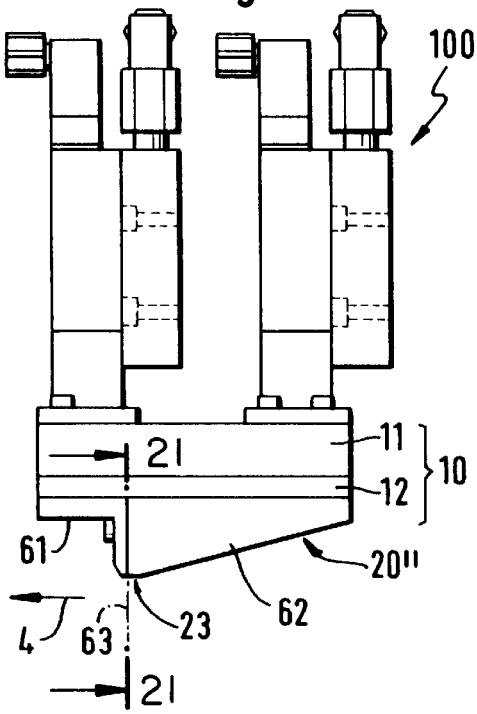
FIG. 18 is a side view corresponding to FIG. 2 of a different embodiment of an applicator head.
Figure 22:
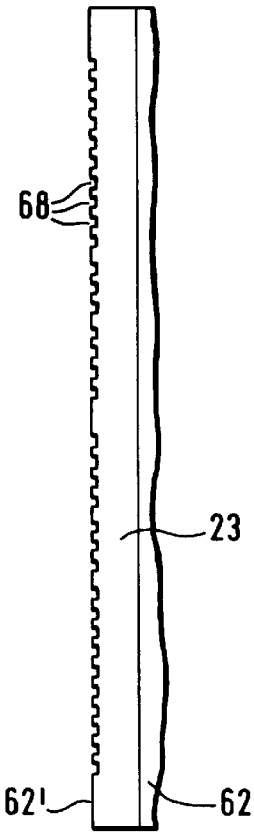
FIG. 22 is a view in accordance with FIG. 21 from the right.

In FIG. 18, the applicator 100 of FIG. 2 is shown once again on a reduced scale, but in this case it comprises a nozzle plate 20" which is divided along a plane 63 perpendicular to the substrate, not shown, and the transport direction 4, into a left part 61, and a right part 62. The parts 61, 62 are set against each other along their flat parting surfaces 61' and 62' as seen in FIG. 20, and are connected to each other by means of screws 67 which are perpendicular to the plane 63.

In the embodiment example of FIGS. 18–22, the exit openings 29 are formed by adjacent grooves 68 which are formed along the opposite parting surfaces 61', 62' of the parts 61, 62. As is evident from FIG. 21, flat chambers 69 are formed in the parting surface 62', and are uniformly supplied with glue or a similar adhesive by means of channels 70. An edge 71 with a width of several millimeters remains between the chambers 69 and the delimitation surface 23 which contains the exit openings 29, and the grooves 68 are milled into such edge portion 71 so as to be disposed perpendicular to the delimitation surface 23, for example as rectangular grooves with a depth of 0.5 mm and a width of 1 mm. The ridges 72 which remain between the grooves 68,68 are just as wide as the grooves 68.

A corresponding groove pattern is milled into the parting surface 61' of the part 61, the grooves 68 of which have the same dimensions as those of the grooves 68 of the part 62, but are offset by the width of one groove in the width direction of the nozzle plate 20". As is evident from FIG. 20, the ridges 72 between the grooves 68 on the one side of the plane 63 therefore close off the grooves 68 on the other side of the plane 63, so that all the grooves 68 are adjacent to the plane 63, and grooves that are adjacent to one another in the cross-wise direction of the plate 20" in the plane 63 abut against each other in a common plane 73 which is perpendicular to the delimitation surface 23, that is, to the substrate, and lies in the transport direction.

In the configuration of FIGS. 18–22, again there are rows 32, 33 of exit openings 29, which are located behind each other in the transport direction and allow separate glue filaments to exit therefrom, which filaments touch each other in the cross-wise direction immediately after exiting, and form a cohesive glue track in the cross-wise direction.

Figure 21:
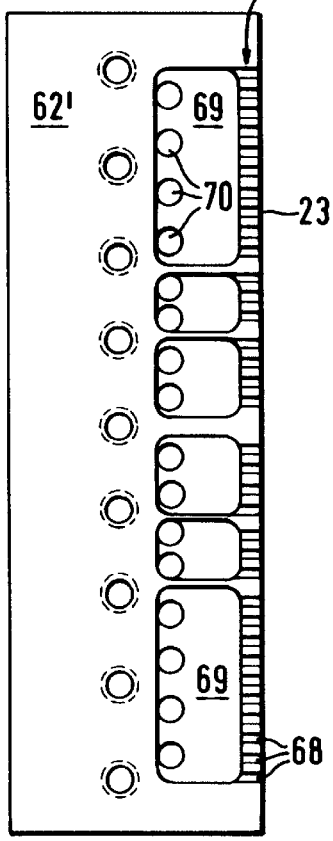
FIG. 21 is a view of the right part of the nozzle plate in FIG. 18, along the line 21—21 in FIG. 18.

The production of milled grooves in the edge 71 portion, as seen in FIG. 21, is simpler than the production of bore patterns, for example those according to FIGS. 12–17.

Figure 24:
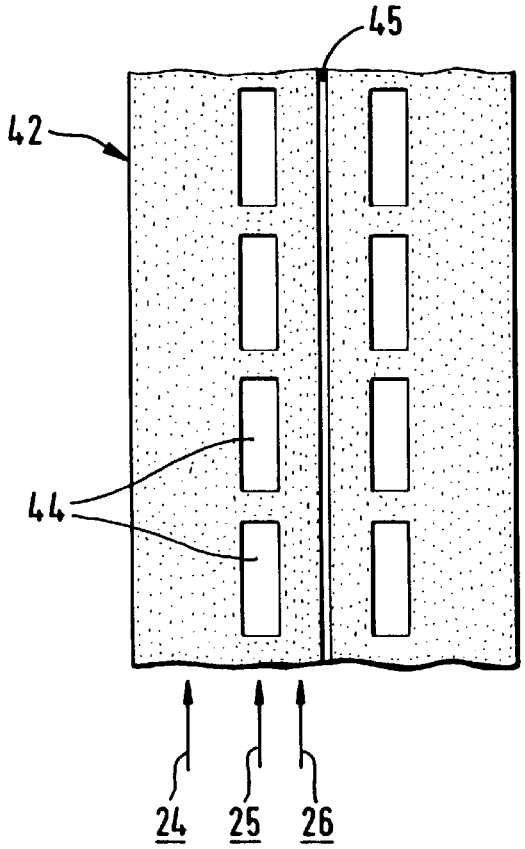
FIG. 24 is a schematic illustration showing a glue pattern on a paper strip which forms the mouthpiece of the cigarettes.
Figure 23:
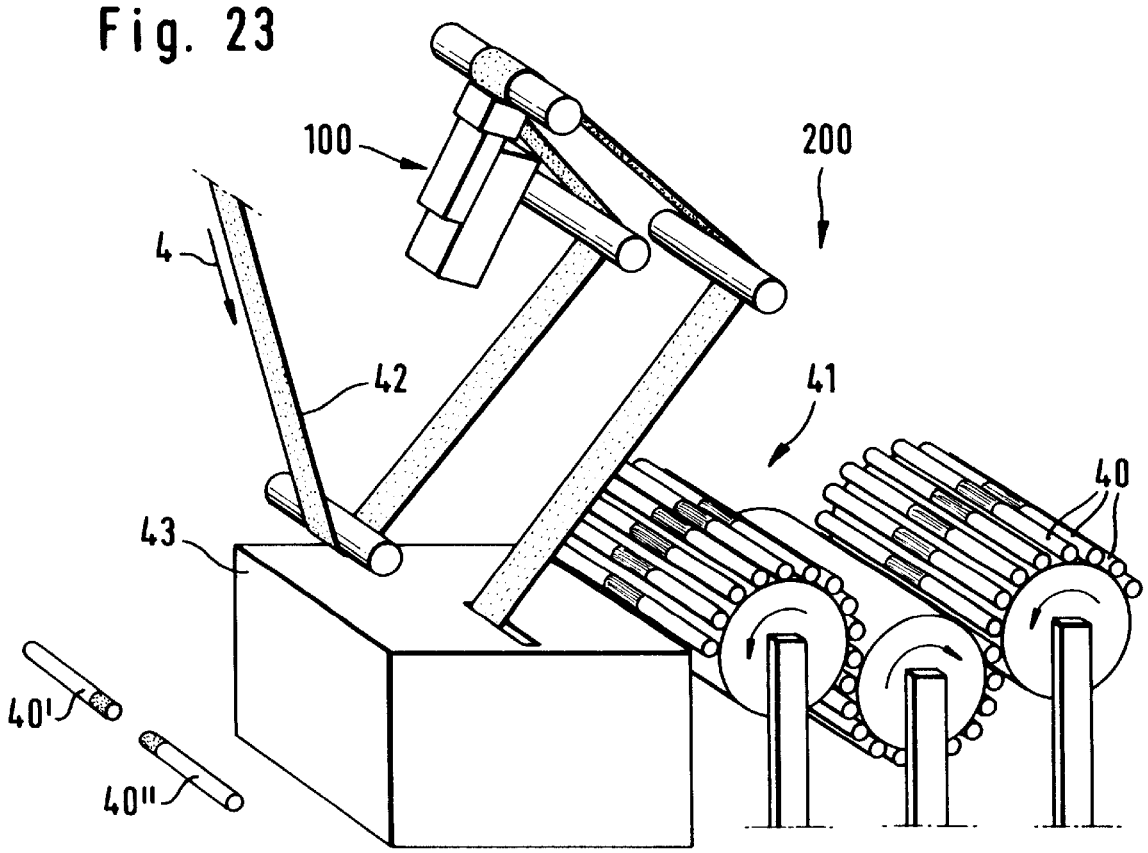
FIG. 23 schematically shows an application example of the invention, in the form of a module from a cigarette production machine.

An application example of the present invention is schematically shown in FIGS. 23 and 24. FIG. 23 discloses a partial assembly 200 of a cigarette production machine. This machine comprises means for affixing the paper mouthpieces to filter cigarettes. The cigarettes 40 are produced as double cigarettes in a different part of the cigarette production machine, with the filter ends still resting against each other. These double cigarettes 40 are conveyed to the assembly by a transport device 41. From the other side, a paper strip 42 runs in, forming the mouthpiece for the double cigarettes 40, which is glued around the cigarettes. The paper strip 42 must be coated with glue according to the pattern shown in FIG. 24, which is done using the applicator 100, which has the nozzle plate 20 of FIG. 5 for this purpose. In the center of the paper strip 42, there is a narrow, glue-free strip 45, and laterally at a distance from strip 45, there is a sequence of glue-free rectangles 44, wherein in each instance, there are provided tiny perforations produced with a laser beam, to supply ancillary air while smoking.

The glue application strips which result in the pattern of FIG. 24 are provided with the reference numbers of the related distributor chambers and underlining in FIG. 24. The relatively broad glue application strip 24 which is located at the left portion of FIG. 24, is produced by the distributor channel 24. The interrupted glue application strip 25 is produced by the distributor chamber 25, which is rhythmically turned on and off. Towards the center, there is the continuous glue application strip 26, which is produced by the distributor chamber 26. In the center, the narrow gluefree strip 45 remains, where the cutting knife will later be applied. This strip 45 is produced by the distance between the distributor chambers 26 and 24' in the region of the longitudinal center line M as seen in FIG. 5.

The strip 42 of mouthpiece paper provided with glue in the applicator 100, in accordance with the pattern in FIG. 24, runs into an apparatus 43, indicated only as a box, in which a segment of the strip 42 is looped around a double cigarette 40 in each instance, at the center thereof, glued in place and cut in the cross-wise direction, whereupon the double cigarette 40, now provided at its center with a double mouthpiece, is cut into two individual cigarettes 40' and 40", as indicated on the left in FIG. 23.

The strip 42 of mouthpiece paper is conducted at a speed of over 200 m/min when it passes over the applicator 100. The glue coating must be very thin and uniform, because any irregularity will result in disruptions of further processing of the cigarettes, and, under some circumstances, even in flavor problems. Furthermore, close tolerances of the glue application width must be maintained in the cross-wise direction, which are made possible by the arrangement 30 of the exit openings 29 in accordance with the teachings of the present invention.

Obviously, many modifications and variations of the present invention are possible in light of the above teachings. It is therefore to be understood that within the scope of the appended claims, the present invention may be practiced otherwise than as specifically described herein.

What is claimed as new and desired to be protected by Letters Patent of the United States of America is:

1. Apparatus for depositing strips of a fluid medium onto a substantially planar substrate as said substrate moves relative to said apparatus, comprising:

a dispensing plate;

a plurality of outlet openings defined within said dispensing plate for dispensing a fluid medium outwardly therefrom;

means for causing relative movement between said plurality of outlet openings defined within said dispensing plate and a substrate onto which said fluid medium is to be dispensed; and means for feeding said fluid medium toward said plurality of outlet openings defined within said dispensing plate and under pressurized conditions such that said fluid medium is discharged from said plurality of outlet openings defined within said dispensing plate and deposited onto said substrate;

wherein said plurality of outlet openings defined within said dispensing plate are arranged within at least two rows extending transversely with respect to the direction of relative movement defined between said plurality of outlet openings and said substrate, and are spaced in said direction of relative movement a predetermined first distance with respect to each other such that at least one row of said at least two rows of outlet openings is disposed behind another row of said at least two rows of outlet openings as considered in said direction of relative movement, said outlet openings disposed within each one of said at least two rows of outlet openings are transversely spaced a predetermined second distance with respect to each other, and said at least two rows of outlet openings are transversely offset with respect to each other such that said outlet openings disposed within said at least one row of said at least two rows of outlet openings are interposed between said outlet openings disposed within said another row of said at least two rows of outlet openings whereby side edge portions of said fluid medium dispensed from said outlet openings disposed within said at least one row of said at least two rows of outlet openings will contact side edge portions of said fluid medium dispensed from said outlet openings disposed within said another row of said at least two rows of outlet openings and merge therewith so as to form a continuum of said fluid medium dispensed from said plurality of outlet openings defined within said dispensing plate.

2. The apparatus as set forth in claim 1, wherein:

said plurality of outlet openings defined within said dispensing plate are arranged within three rows spaced said predetermined distance with respect to each other in said direction of relative movement defined between said plurality of outlet openings and said substrate.

3. The apparatus as set forth in claim 2, wherein:

successive ones of said plurality of outlet openings disposed within said three spaced rows of outlet openings are disposed along linear loci which define predetermined angles with respect to said direction of relative movement defined between said plurality of outlet openings and said substrate.

4. The apparatus as set forth in claim 3, wherein:

successive ones of said plurality of outlet openings disposed within said three spaced rows of outlet openings are disposed along linear loci which define predetermined angles with respect to said direction of relative movement defined between said plurality of outlet openings and said substrate wherein said linear loci are arranged in a zig-zag pattern.

5. The apparatus as set forth in claim 1, wherein:

said plurality of outlet openings are disposed within two rows; and said predetermined second distance defined between each pair of adjacent ones of said outlet openings disposed within each one of said two rows of outlet openings is substantially equal to the diameter of each one of said outlet openings disposed within each one of said two rows of outlet openings.

6. The apparatus as set forth in claim 1, wherein:

said plurality of outlet openings are disposed within two rows; and said predetermined second distance defined between each pair of adjacent ones of said outlet openings disposed within a first one of said two rows of outlet openings is substantially equal to the diameter of each one of said outlet openings disposed within the second one of said two rows of outlet openings.

7. The apparatus as set forth in claim 1, wherein:

said predetermined second distance defined between successive ones of said outlet openings disposed within each one of said at least two rows of outlet openings and transversely spaced with respect to each other is such that peripheral circumferential portions of said outlet openings disposed within said at least one row of said at least two rows overlap peripheral circumferential portions of said outlet openings disposed within said another row of said at least two rows of outlet openings, in a transverse direction, by an amount of up to twenty percent (20%).

8. The apparatus as set forth in claim 1, wherein:

said predetermined distance defined between said rows of outlet openings in said direction of relative movement is such that peripheral circumferential portions of said outlet openings disposed within said at least one row of said at least two rows overlap peripheral circumferential portions of said outlet openings disposed within said another row of said at least two rows of outlet openings, in said direction of relative movement, by an amount of up to twenty percent (20%).

9. The apparatus as set forth in claim 1, wherein:

the diameters of all of said plurality of outlet openings disposed within said at least two rows of outlet openings are the same.

10. The apparatus as set forth in claim 1, wherein:

the diameters of said plurality of outlet openings disposed within said at least two rows of outlet openings are different within said at least two rows of outlet openings.

11. The apparatus as set forth in claim 10, wherein:

the diameters of said outlet openings disposed within said at least one row are all the same with respect to each other but are different from the diameters of said outlet openings disposed within said another row of said at least two rows of outlet openings.

12. The apparatus as set forth in claim 10, wherein:

the diameters of said plurality of outlet openings disposed within each one of said at least two rows of outlet openings are different with respect to each other.

13. The apparatus as set forth in claim 12, wherein:

the diameters of end ones of said plurality of outlet openings disposed within each one of said at least two rows of outlet openings are smaller than the diameters of the other outlet openings disposed within the respective row of outlet openings.

14. The apparatus as set forth in claim 1, wherein:

said dispensing plate is fixed; and said means for causing said relative movement between said plurality of outlet openings defined within said dispensing plate and said substrate comprises a conveyor for conveying said substrate in said direction of relative movement past said plurality of outlet openings.

15. The apparatus as set forth in claim 1, further comprising:

at least one distribution chamber defined within said dispensing plate, fluidically connected at one end thereof to a source of said fluid medium to be dispensed, and fluidically connected at an opposite end thereof to some of said plurality of outlet openings so as to supply said fluid medium from said source of said fluid medium to said some of said plurality of outlet openings.

16. The apparatus as set forth in claim 15, wherein:

said at least one distribution chamber comprises a plurality of distribution chambers arranged transversely across said dispensing plate and within which all of said plurality of outlet openings are disposed so as to be arranged within said at least two transversely extending rows of outlet openings.

17. The apparatus as set forth in claim 16, wherein:

adjacent boundaries of said plurality of distribution chambers overlap each other transversely such that said predetermined second distance defined between transversely spaced outlet openings within each one of said at least two rows of outlet openings is the same within each one of said plurality of distribution chambers as well as between transversely spaced, adjacent outlet openings disposed within adjacent ones of said plurality of distribution chambers upon opposite sides of one of said adjacent boundaries of said plurality of distribution chambers.

18. The apparatus as set forth in claim 17, wherein:

said adjacent boundaries defined between adjacent ends of said plurality of distribution chambers extend obliquely, with respect to said direction of relative movement, between an outlet opening of one distribution chamber disposed within one of said at least two rows and an outlet opening of the other one of said distribution chambers disposed within another one of said at least two rows of said outlet openings.

19. The apparatus as set forth in claim 1, wherein:

said dispensing plate comprises a recessed region into which said plurality of outlet openings open so as to accommodate a portion of said dispensed fluid medium as said dispensed fluid medium is interposed between said plurality of outlet openings and said substrate.

20. The apparatus as set forth in claim 1, wherein:

said fluid medium comprises an adhesive; and said substrate comprises a paper product.

21. The apparatus as set forth in claim 1, wherein:

each of said outlet openings has a circular cross-sectional configuration.

22. The apparatus as set forth in claim 21, wherein:

the diametrical extent of each one of said plurality of outlet openings is within the range of 0.2 to 1.0 mm.

23. The apparatus as set forth in claim 1, wherein:

said plurality of outlet openings comprise grooves disposed upon opposite sides of a plane which is disposed transversely with respect to said direction of relative movement defined between said plurality of outlet openings and said substrate, and said at least two rows of transversely offset outlet openings are offset with respect to each other such that side edge portions of said grooves disposed within said at least two rows of outlet openings and upon said opposite sides of said plane are disposed within common planes which extend parallel to said direction of relative movement defined between said plurality of outlet openings and said substrate.

24. The apparatus as set forth in claim 23, wherein:

each one of said grooves is substantially rectangular in configuration, has a depth which is within the range of 0.1 to 1.0 mm, and has a width which is within the range of 0.5 to 2.0 mm.

25. The apparatus as set forth in claim 1, wherein:

said plurality of outlet openings are defined within a strip member which is fabricated from a material which exhibits greater wear resistance than the material comprising said dispensing plate.

26. The apparatus as set forth in claim 25, wherein:

said strip member is electrically conductive.

* * * * *